US010034099B2

(12) United States Patent
Acharya et al.

(10) Patent No.: US 10,034,099 B2
(45) Date of Patent: Jul. 24, 2018

(54) VOWEL AND CONSONANT DISCRIMINATING MICROPHONES USING CARBON NANOTUBES

(71) Applicant: International Business Machines Corporation, Armonk, NY (US)

(72) Inventors: Anusha Chippigiri Acharya, Dallas, TX (US); Mukundan Sundararajan, Bangalore (IN)

(73) Assignee: International Business Machines Corporation, Armonk, NY (US)

( * ) Notice: Subject to any disclaimer, the term of this patent is extended or adjusted under 35 U.S.C. 154(b) by 136 days.

(21) Appl. No.: 14/800,793

(22) Filed: Jul. 16, 2015

(65) Prior Publication Data

US 2017/0019738 A1 Jan. 19, 2017

(51) Int. Cl.
*H04R 19/04* (2006.01)
*H04R 23/00* (2006.01)

(52) U.S. Cl.
CPC ..... *H04R 19/04* (2013.01); *H04R 23/002* (2013.01); *Y10S 977/733* (2013.01); *Y10S 977/742* (2013.01); *Y10S 977/932* (2013.01)

(58) Field of Classification Search
CPC .. B82Y 15/00; H04R 23/00; H04R 2201/003; H04R 23/002; Y10S 977/932; Y10S 977/733; Y10S 977/742
USPC ..... 381/164
See application file for complete search history.

(56) References Cited

U.S. PATENT DOCUMENTS 6,314,183 B1 * 11/2001 Pehrsson ..... H04M 1/0214 379/433.06
7,709,243 B2 * 5/2010 Park ..... B82Y 5/00 435/283.1
8,405,189 B1 * 3/2013 Ward ..... H01L 28/40 257/532
9,544,672 B2 * 1/2017 Nawrocki ..... H04R 1/04
2002/0159943 A1 * 10/2002 Smalley ..... B01J 19/081 423/447.1
2004/0004485 A1 * 1/2004 Lee ..... B82Y 30/00 324/658
2007/0134555 A1 * 6/2007 Ren ..... B82Y 10/00 429/245

(Continued)

FOREIGN PATENT DOCUMENTS

DE 102005059270 A1 6/2007
DE 10201000039 * 8/2011 ..... H04R 23/00

(Continued)

OTHER PUBLICATIONS

Chen et al., "A Capacitive Humidity Sensor Based on Multi-Wall Carbon Nanotubes (MWCNTs)", Sensors 2009, 9, 7431-7444; doi: 10.3390/s90907341, Sensors ISSN 1424-8220, pp. 1-14.

(Continued)

*Primary Examiner* — Oyesola C Ojo
(74) *Attorney, Agent, or Firm* — Monchai Chuaychoo

(57) ABSTRACT

A condenser microphone and a method for discriminates a first segment and a second segment in a spoken sound, is provided by using carbon nanotube bundles as capacitor materials. Such capacitor capacitance varies due to the quantum thermal mechanism of CNTs when a spoken sound containing vowel segments and consonant segments passes through the CNTs, so that the vowel segments and the consonant segments can be detected and separated.

18 Claims, 4 Drawing Sheets

(56) References Cited

U.S. PATENT DOCUMENTS

2009/0112115 A1* 4/2009 Huang ..... A61B 5/083 600/532
2010/0019159 A1* 1/2010 Jiang ..... G10K 15/04 250/370.01
2010/0144205 A1* 6/2010 Searfass ..... B82Y 30/00 439/658
2010/0177914 A1* 7/2010 Heite ..... H04R 19/013 381/191
2011/0006286 A1* 1/2011 Wang ..... H04R 17/02 257/24
2012/0148074 A1* 6/2012 Bastiaens ..... H04R 19/02 381/191
2014/0015777 A1* 1/2014 Park ..... G06F 3/044 345/173
2015/0350763 A1* 12/2015 Chadbourne ..... H04R 1/1033 381/384
2016/0150324 A1* 5/2016 Yoo ..... H04R 19/04 381/356
2016/0157022 A1* 6/2016 Zhou ..... H04R 19/02 381/191
2016/0173967 A1* 6/2016 Nawrocki ..... H04R 1/04 381/111

FOREIGN PATENT DOCUMENTS

DE 102010000392 * 8/2011 ..... H04R 23/00
JP 2009071003 A * 4/2009
JP 2011014684 * 1/2011 ..... H05K 9/00
JP 5619529 B2 11/2014

OTHER PUBLICATIONS

Choi et al., "Humidity Sensor Using an Air Capacitor", Transactions on Electrical and Electronic Materials, vol. 14, pp. 182-186, Aug. 25, 2013, DOI: http://dx.doi.org/10.4313/TEEM.2013.14.4.182.

Hu et al., "Air flow through carbon nanotube arrays", Applied Physics Letters (vol. 91, Issue: 13), pp. 131905-131905—Sep. 3, 2007, ISSN: 0003-6951, DOI: 10.1063/1.2793174, Date of current Version: Jun. 18, 2009.

Orphanou et al., "Modeling of a carbon nanotube ultracapacitor", 2012 Nanotechnology, doi:10.1088/0957-4484/23/9/095401, Published Feb. 6, 2012, © 2012 IOP Publishing Ltd., <http://iopscience.iop.org/0957-4484/23/9/095401/pdf/0957-4484_23_9_095401.pdf>, pp. 1-2.

Xiao et al., "Flexible, Stretchable, Transparent Carbon Nanotube Thin Film Loudspeakers", 10.1021/n1802750z, © 2008 American Chemical Society, Published on Web Oct. 29, 2008, pp. 4539-4545.

* cited by examiner

CAPACITANCE VARIATION FOR CONSONANTS AND VOWELS

VOWEL AND CONSONANT DISCRIMINATING MICROPHONES USING CARBON NANOTUBES

BACKGROUND OF THE INVENTION

The present invention relates generally to the field of microphone technology, and more particularly to a microphone device and a method using carbon nanotubes (CNTs) for discriminates a first segment and a second segment in a spoken sound.

A microphone is an acoustic-to-electric transducer or sensor device that converts the impinging sound in air into an electrical signal. The sensitive transducer element of a microphone is referred to as the microphone's element or capsule. Sound is first converted to mechanical motion by means of a diaphragm, the motion of which is then converted to an electrical signal. Additionally, a complete microphone includes a housing, some means of bringing the electrical signal from the element to other equipment, and often an electronic circuit to adapt the output of the capsule to the equipment being driven.

Microphones are used in many applications including telephones, hearing aids, public address systems for concert halls and public events, motion picture production, live and recorded audio engineering, two-way radios, megaphones, radio and television broadcasting, and in computers for recording voice, speech recognition, VoIP, and for non-acoustic purposes such as ultrasonic checking or knock sensors.

Microphones are generally divided into different categories according to their transducer principle, including electromagnetic induction (i.e., dynamic microphones), capacitance change (i.e., condenser microphones) and piezoelectricity (i.e., piezoelectric microphones). The condenser microphone, is also called a capacitor microphone or electrostatic microphone. In the condenser microphone, the diaphragm acts as one plate of a capacitor, and the vibrations of the diaphragm driven by the sound wave pressure produce changes in the distance between the capacitor plates to produce an electrical signal from air pressure variations.

SUMMARY

According to an aspect of the present invention, there is a microphone that discriminate a vowel segment and a consonant segment in a spoken sound, comprising: a set of carbon nanotube bundles, the spoken sound passing through the set of carbon nanotube bundles; and an electrode block, the electrode block including a set of conducting plates and an electrode electrically connecting to the set of conducting plates; wherein the carbon nanotube bundle of the set of carbon nanotube bundles is located adjacent to the electrode block.

According to another aspect of the present invention, there is a method for discriminating a first segment and a second segment in a spoken sound, comprising: passing a spoken sound through a set of carbon nanotube bundles; connecting an electrode in an electrode block electrically to a set of conducting plates in the electrode block; and locating a carbon nanotube bundle of the set of carbon nanotube bundles adjacent to the electrode block.

DETAILED DESCRIPTION

Figure 2:
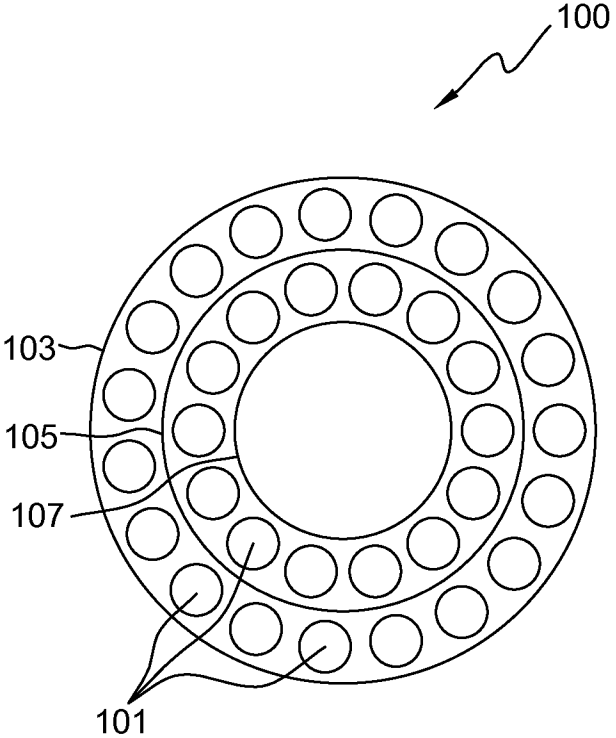
FIG. 2 illustrates a cross-sectional view of the microphone capsule in the cutting plane as shown in FIG. 1.

Microphones typically use sound waves impinging on a diaphragm to create enough stress on the diaphragm to modify electrical parameters of the associated electrical components—be it the condenser or electret or the coil microphone. This is based on the theory that sound generation and propagation through air as longitudinal waves move the air particles faster or slower based on the articulation.

Conventionally, the microphone uses the sound waves to create pressure on the diaphragms, and the variation of a parameter is then measured that is related to the sound wave, as shown in an exemplary equation: $F=\Delta n\times\Delta v\times m$, where: F is the sound level (i.e., a force that is applied on the microphone diaphragm); n is the number of air molecules (i.e., number density of air molecules); v is the sound speed; and m is the mass of air particle. As can be seen from this equation, whether the number of air molecules (n) or the change in sound speed (v), the same sound level and type is measured. This has the disadvantage of treating the sound in a single form, whereas the spoken sound generation happens in two areas: the mouth (i.e., buccal cavity) and the vocal folds that can be split to the consonant and vowel parts. Thus, not being able to differentiate the consonant and vowel hinders efficient speech identification. In addition, in the above equation, the mass of air particles is assumed to be constant. But mass of air particles should also be variable since for vowels, the moisture content is expected to be higher making the mass of air particles higher for vowels.

Further, identification of the vowel part and the consonant part in a spoken sound is conventionally performed by employing frequency analysis using the formant availability only after the sound signal has been captured by a microphone. A solution of enabling microphones themselves to be able to provide such a capability are required.

Some embodiments of the present invention provide a new class of microphones in which the air density and other characteristics change with the type of spoken sound is detected. The type of sound herein refers to either a vowel or a consonant. Such change creates a difference between parts of spoken sound originating as vowels and consonants which can be identified. Accordingly, a characteristic parameter varies based on this difference. Such a microphone would not only be able to help distinguish the vowel component and the consonant component in a spoken sound, but also measures the voice signals that can be used for further analysis for speech and voice identification.

In some embodiments, the sound laden air flowing through the carbon nanotube changes a characteristic of the tube wall from the flowing air on such walls, and the characteristics of air changing due to type of the spoken sound waves it carries.

In some embodiments, the other characteristics include, but are not limited to, velocity of air particles, mass of the air particles that varies with the amount of moisture, and the randomness in motion direction of air particles. In some embodiments, examples of the characteristic parameters include electrical capacitance, electrical resistance, and/or stiffness of material.

In some embodiments, the measurement of the air density and other characteristics are performed using a bundle of hollow cylinders that are composed of a microphone element/capsule. Some measurable characteristic or parameter, such as resistance, capacitance, inductance, tensile strength, and so forth, changes as a function of the air density. Alternatively, other characteristics cause the change of the measurable characteristic/parameter.

In some embodiments, the materials of such cylinders support the dynamic characteristics of the changing sound. The dynamic characteristics herein include sound loudness, sound pitch, and sound quality (e.g., timbre or richness). In addition to the air density, moisture content, sound velocity, and motion direction of air particles, the variation in sound loudness/pitch/quality are measured by the microphone for the changes of the measurable parameters, which are passed to an apparatus that supports systems for processing the sound signals further.

In some embodiments of the present invention, the microphone is composed of a bundle of cylinders made of carbon nanotubes (CNTs). Such CNTs have the property of maintaining a natural flow of air through the hollow tubes in a horizontal configuration, as well as have a measurable capacitance that changes with the density of air flowing through. Herein the density of air refers to the number density of air molecule. Alternatively, the density of air refers to the mass density of air. Such a microphone exhibits the characteristics of variation of the capacitance due to several effects. One exemplary effect is the quantum thermal effect that incorporates both the air density change and the water vapor (moisture) difference. The dielectric constant of CNTs in such a microphone varies as a function of both the water vapor content in the sound from the vocal folds and the air density in the flowing air wave, which causes the capacitance of CNT to vary. Also from the above equation, it can be seen that if the air density is higher for vowels, the air velocity is going to be lower and vice-versa. At a molecular scale, the slower velocity would mean that the total electric charge in a zone is larger, giving rise to a higher capacitance for a vowel sound segment.

Reference will now be made in detail to some embodiments of the present invention, examples of which are illustrated in the accompanying figures. Wherever possible, the same reference numbers will be used throughout the figures to refer to the same or like parts.

The microphones in the present invention can be constructed using several materials. In an exemplary embodiment discussed below, carbon nanotubes (CNTs) are used to fabricate a microphone.

As mentioned above, with air flow, CNTs exhibit behaviors including the quantum thermal mechanism and the capacitance variation capability from applied voltage, which demonstrates the applicability of CNTs for fabricating a condenser microphone. In some embodiments of the present invention, CNTs are fabricated as capacitor bundles in longitudinal construction. In some embodiments of the present invention, CNTs are built as the dielectric membranes between electrode blocks. Spoken sound from the vocal folds contains more moisture and is denser. When the moist air is to be passing through such a microphone, the moisture variation in the air flow would cause capacitance variations of CNTs inside the microphone. Further, the velocity change in air flow passing through CNTs inside the microphone also causes a change in capacitance of the CNTs.

Figure 1:
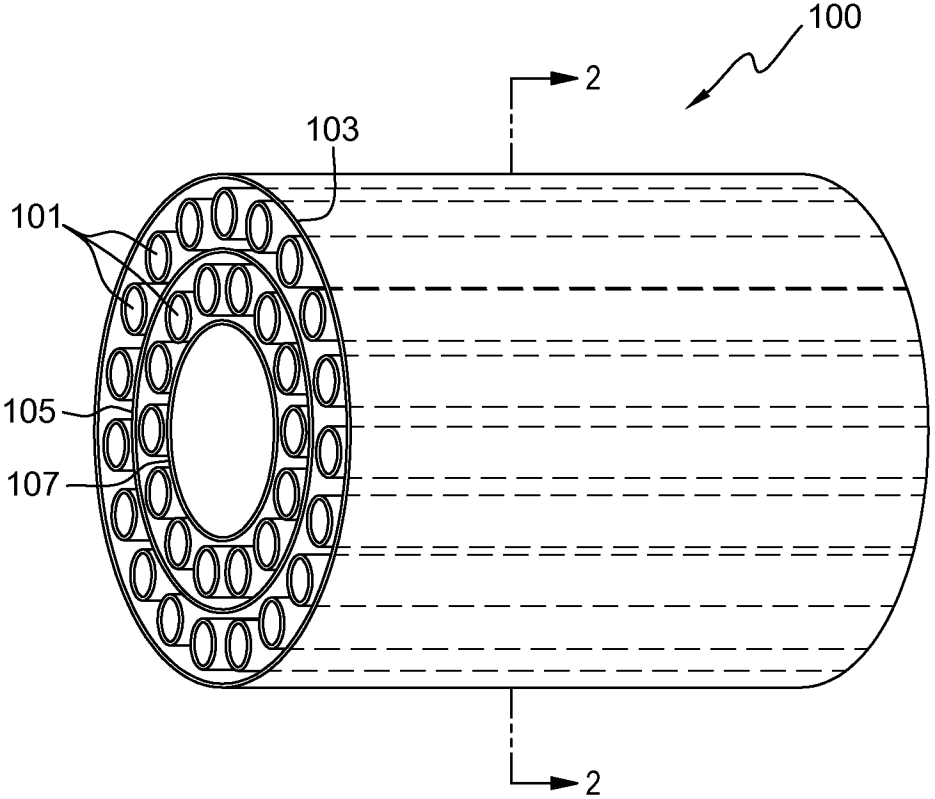
FIG. 1 illustrates an exemplary microphone capsule made of carbon nanotubes (CNTs) in a perspective view according to an embodiment of the present invention.

Referring to FIG. 1, illustrated is a schematic diagram of an exemplary microphone capsule/element 100 in a perspective view according to an embodiment of the present disclosure. The microphone capsule 100 includes CNTs capacitor bundles in longitudinal construction and other components (not shown). A condenser microphone can be constructed from such microphone capsule 100 and other required parts (not shown). The CNTs capacitor bundles include CNTs 101 bundled in longitudinal direction, conducting cylinders 103,105 and 107, and electric terminals (not shown). The CNTs may be single-walled CNTs or multiwalled CNTs. In this example, the CNTs are a mix of single-walled CNTs and multi-walled CNTs. The CNTs can be fabricated into bundles by any suitable method including chemical vapor deposition or CoMoCAT® process. The bundled CNTs are placed between conducting cylinders to form CNT capacitor bundles (also refer to as CNT bundle capacitor) where the CNTs act as a dielectric material of capacitor and the conducting cylinders perform as capacitor plates on which electrical voltages are applied through electric terminals (not shown). The conducting cylinders can be made of any suitable materials including gold, copper and other conducting materials that can form the base for the fabrication process.

Referring to FIG. 2, illustrated is a schematic diagram of the exemplary microphone capsule/element 100 in a cutting plane view as shown in FIG. 1 according to an embodiment of the present disclosure. As mentioned above, in this exemplary embodiment, the CNTs are a mix of single-walled CNTs and multi-walled CNTs where single-walled CNTs may have different diameters and multi-walled CNTs may have different outer diameters and different inner diameters. Further, the CNTs may have different lengths. As shown in FIGS. 1 and 2, it is only for illustrative purpose that all the CNTs are depicted as a same length and a same diameter. Further, the conducting cylinders may have different thickness and length.

Figure 3:
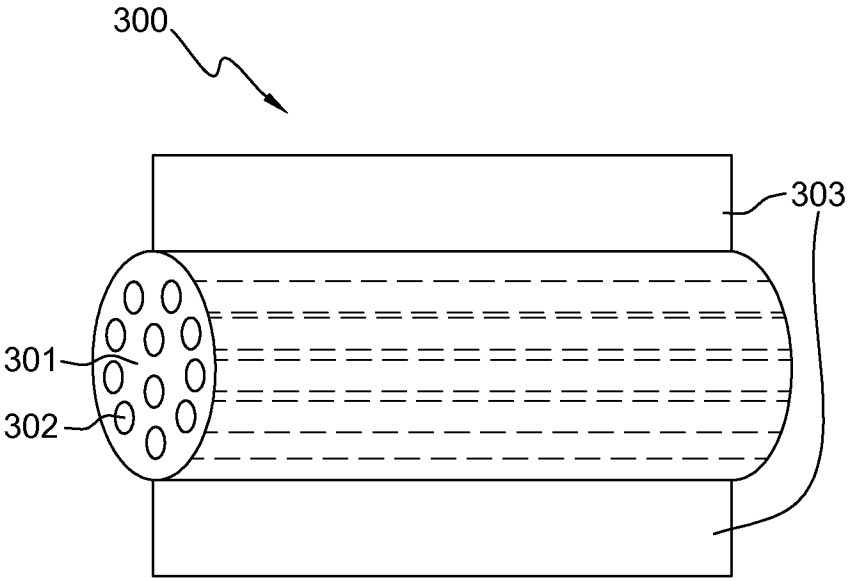
FIG. 3 illustrates another exemplary microphone capsule made of CNTs in a perspective view according to an embodiment of the present invention.

In some embodiments of the present invention, CNTs are built as an electric membrane between electrode blocks. As shown in FIG. 3, illustrated is a schematic diagram of an exemplary microphone capsule/element 300 in a perspective view according to an embodiment of the present disclosure. The microphone capsule 300 includes CNTs dielectric membrane 301, electrode blocks 303, and other components (not shown). A condenser microphone can be constructed from such microphone capsule 300 and other required parts (not shown). The CNTs membrane 301 comprises CNTs 302 bundled in longitudinal direction. The CNTs may be single-walled CNTs or multi-walled CNTs. In this example, the CNTs are a mix of single-walled CNTs and multi-walled CNTs. The CNTs can be fabricated into bundles by any suitable method including self assembly on gold surfaces and AFM (atomic force microscopy) based nanomanipulation system. The bundled CNTs are placed between electrode blocks 303.

Figure 4:
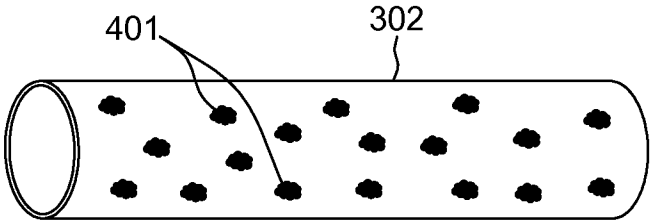
FIG. 4 illustrates an exemplary CNT in the exemplary microphone capsule in FIG. 3 wherein the CNT is filled with air molecules when a spoken sound passes through the CNT.

Referring to FIG. 4, illustrated is a schematic diagram of a single CNT 302 of CNTs dielectric membrane 301 in a perspective view. The CNT 302 is filled with air molecules 401 when an air flow from spoken sound passes through the tube of CNT 302. An air flow segment with a higher air density (herein the number density of air molecule) arises when vowel formation in the vocal folds appears in the air flow; an air flow segment with a lower air density (herein the number density of air molecule) arises when consonant formation appears in the air flow. The different air densities in different air flow segments cause changes to the measured characteristics in the microphone including CNT electrical capacitance, CNT electrical resistance, CNT inductance, and stiffness or tensile strength of CNTs, such that vowel formation and consonant formation can be recognized in the microphone. Further, such changes in the measured characteristics may be used by downstream processing systems for speech and musical sound engineering.

Figure 5:
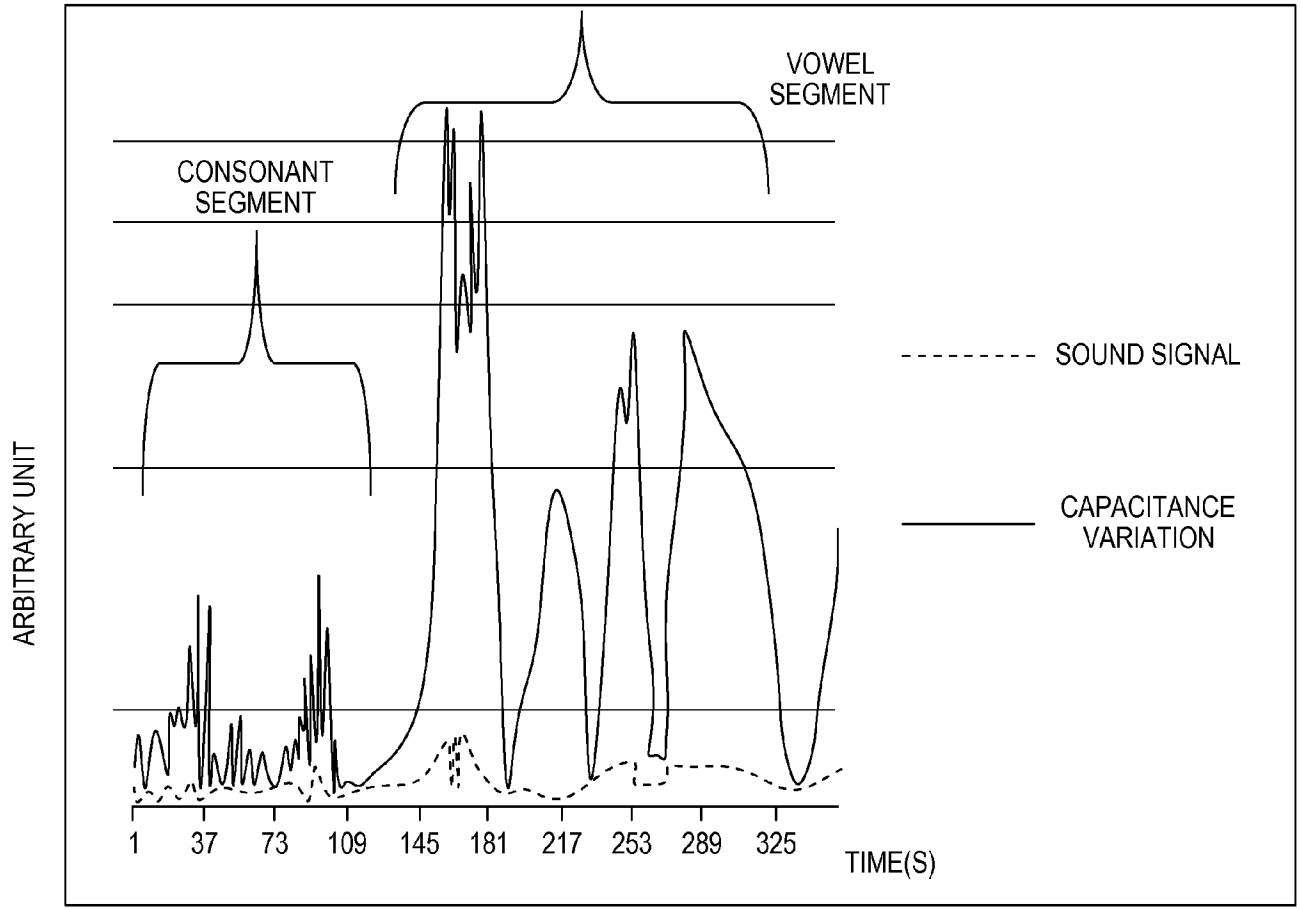
FIG. 5 illustrates a diagram of capacitance that varies with vowel segments and consonant segments in a spoken sound.

In this exemplary embodiment, the measured characteristic is CNT capacitance. FIG. 5 shows the difference in capacitance between the capacitance caused by vowels and the capacitance caused by consonants. The abscissa in FIG. 3 represents the sampling time in unit of second, and the ordinate represents the sound level/the capacitance level in an arbitrary unit. The sound level signal is depicted in the dotted line, and the air capacitance in CNTs corresponding to the sound signal is plotted as the solid line. In a microphone fabricated from CNTs, the quantum mechanisms of CNTs are responsible for the varying air dielectric constant in CNTs. In the case of vowel segments in a spoken sound, due to a higher number of air molecules, the capacitance variation is higher as shown in FIG. 5 (labeled as vowel segment). Accordingly, these air molecules travel at a lower velocity through the CNTs, giving more time for causing the required capacitance characteristic. In the case of consonants in a spoken sound, due to a lower number of air molecules, the capacitance variation is lower as shown in FIG. 5 (labeled as consonant segment). Accordingly, these air molecules travel at a higher velocity through the CNTs, giving lesser time for causing the required capacitance. Thus, vowel segments and consonant segments in a spoken sound can be detected and separated based on such inverse capacitance characteristic.

Figure 6:
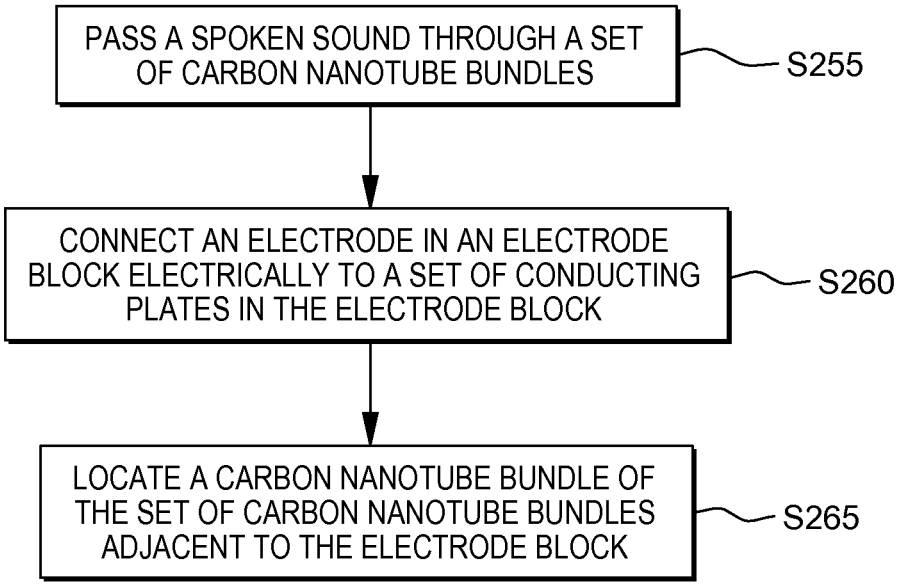
FIG. 6 is a flowchart showing a method for determining vowel segments and consonant segments in a spoken sound.

FIG. 6 shows a flowchart depicting a first method according to the present invention for determining a first segment (e.g., a vowel segment) and a second segment (e.g., a consonant segment) in a spoken sound. This method will now be discussed, over the course of the following paragraphs.

Processing begins at step S255, where a spoken sound passes through a set of carbon nanotube bundles. In this example, the set of carbon nanotube bundles may be fabricated by one of a chemical vapor deposition process and a CoMoCAT® process. The first segment and the second segment may cause variations on a plurality of characteristics. the plurality of characteristics includes at least one of the following: (i) air molecule number density in the spoken sound; (ii) velocity of air molecules in the spoken sound; (iii) mass of air molecules in the spoken sound; and (iv) randomness in motion direction of air molecules in the spoken sound.

Further, the plurality of characteristics may cause variations on a plurality of characteristic parameters. The plurality of character parameters includes at least one of the following: (i) electrical capacitance of the set of carbon nanotube bundles; (ii) electrical resistance of the set of carbon nanotube bundles; (iii) stiffness of the set of carbon nanotube bundles; (iv) electrical capacitance of the set of carbon nanotube bundles; (v) electrical inductance of the set of carbon nanotube bundles; and (vi) tensile strength of the set of carbon nanotube bundles.

Processing proceeds to step S260, where an electrode in an electrode block is connected electrically to a set of conducting plates in the electrode block. In this example, the set of conducting plates are conducting cylinders. The set of conducting plates are made of materials including at least one of the following: gold, copper, and combination thereof.

Processing ends at step S265, where a carbon nanotube bundle of the set of carbon nanotube bundles is located adjacent to the electrode block. In this example, at least one carbon nanotube is located in a longitudinal direction in the set of carbon nanotube bundles.

Further, the set of carbon nanotube bundles supports a plurality of dynamic characteristics of the spoken sound. The plurality of dynamic characteristics includes at least one of the following: (i) sound loudness; (ii) sound pitch; and (iii) sound quality including timbre and richness. Signals of the plurality of dynamic characteristics are passed to an apparatus that supports systems for processing the spoken sound.

Some embodiments of the present invention may include one, or more, of the following features, characteristics and/or advantages: (i) such a microphone is able to help distinguish the vowel component and the consonant component in a spoken sound; and/or (ii) such a microphone is able to measure the spoken voice signals that can be used for further analysis for speech and voice.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

Present invention: should not be taken as an absolute indication that the subject matter described by the term "present invention" is covered by either the claims as they are filed, or by the claims that may eventually issue after patent prosecution; while the term "present invention" is used to help the reader to get a general feel for which disclosures herein that are believed as maybe being new, this understanding, as indicated by use of the term "present invention," is tentative and provisional and subject to change over the course of patent prosecution as relevant information is developed and as the claims are potentially amended.

Embodiment: see definition of "present invention" above—similar cautions apply to the term "embodiment."

and/or: inclusive or; for example, A, B "and/or" C means that at least one of A or B or C is true and applicable.

What is claimed is:

1. An apparatus for differentiating between vowels and consonants in a spoken sound, the apparatus comprising:

a microphone configured to receive the spoken sound and generate an output signal, the microphone including:

a set of carbon nanotube bundles configured to receive the spoken sound, wherein the set of carbon nanotube bundles includes carbon nanotubes of varying lengths and thicknesses, wherein the carbon nanotube bundles in the set of carbon nanotube bundles are arranged parallel to each other and wherein the set of carbon nanotube bundles provide an output for differentiating the spoken sound as vowels and consonants;

an electrode block configured to measure variation in a set of characteristic parameters of the set of carbon nanotube bundles caused by the received spoken sound and generate the output signal based on the measured variation in the set of characteristic parameters, wherein the electrode block includes a set of conducting plates and an electrode electrically connected to the set of conducting plates, and wherein the set of carbon nanotube bundles is located adjacent to the electrode block in a longitudinal direction.

2. The apparatus of claim 1, wherein the set of conducting plates are conducting cylinders.

3. The apparatus of claim 1, wherein the set of conducting plates are made of a material selected from the group consisting of: gold, copper, and a combination of gold and copper.

4. The apparatus of claim 1, wherein the set of carbon nanotube bundles are fabricated by at least one of a chemical vapor deposition process and a CoMoCAT® process.

5. The apparatus of claim 1, wherein:

the set of carbon nanotube bundles are reactive to a variation in a set of characteristics of the spoken sound; and the set of characteristics is selected from the group consisting of: (i) air molecule number density in the spoken sound; (ii) velocity of air molecules in the spoken sound; (iii) mass of air molecules in the spoken sound; and (iv) randomness in motion direction of air molecules in the spoken sound.

6. The apparatus of claim 5, wherein:

the set of carbon nanotube bundles are reactive to the variation in the set of characteristics based on a variation in set of characteristic parameters of the set of carbon nanotube bundles; and the set of characteristic parameters is selected from the group consisting of: (i) electrical capacitance of the set of carbon nanotube bundles; (ii) electrical resistance of the set of carbon nanotube bundles; (iii) stiffness of the set of carbon nanotube bundles; (iv) electrical inductance of the set of carbon nanotube bundles; and (v) tensile strength of the set of carbon nanotube bundles.

7. The apparatus of claim 1, further comprises:

a system having a processor that is communicatively coupled to the microphone, wherein the system is configured to:

receive, from the microphone, the output signal;

process the output signal; and determine, based on the processing, that a first segment of the spoken sound corresponds to a consonant and that a second segment of the spoken sound corresponds to a vowel.

8. The apparatus of claim 1, wherein:

the set of carbon nanotube bundles support a set of dynamic characteristics of the spoken sound; and the set of dynamic characteristics is selected from the group consisting of: (i) sound loudness; (ii) sound pitch; and (iii) sound quality including timbre and richness.

9. The apparatus of claim 1, wherein the set of carbon nanotube bundles is selected from the group consisting of: (i) single-walled carbon nanotubes; (ii) multi-walled carbon nanotubes; and (iii) a mix of single-walled carbon nanotubes and multi-walled carbon nanotubes.

10. A method for making an apparatus for differentiating between vowels and consonants in a spoken sound, the method comprising:

connecting an electrode in an electrode block electrically to a set of conducting plates in the electrode block;

placing a set of carbon nanotube bundles adjacent to the electrode block in a longitudinal direction; and placing each carbon nanotube of the set of carbon nanotube bundles:

parallel to each other carbon nanotube of the set of carbon nanotube bundles, and in the same longitudinal direction as the set of carbon nanotube bundles, wherein each carbon nanotube having different lengths and thickness from other carbon nanotube provides an output for differentiating the spoken sound as vowels and consonants.

11. The method of claim 10, further comprising:

fabricating the set of carbon nanotube bundles in a form, wherein the form is selected from the group consisting of: (i) single-walled carbon nanotubes; (ii) multi-walled carbon nanotubes; and (iii) a mix of single-walled carbon nanotubes and multi-walled carbon nanotubes.

12. The method of claim 10, further comprising:

fabricating the set of carbon nanotube bundles by at least one of a chemical vapor deposition process and a CoMoCAT® process.

13. A method for using an apparatus for differentiating between vowels and consonants in a spoken sound, the method comprising:

passing a spoken sound longitudinally through a set of carbon nanotube bundles, wherein each carbon nanotube having different lengths and thickness from other carbon nanotube provides an output for differentiating the spoken sound as vowels and consonants;

detecting variations on a set of characteristic parameters of the set of carbon nanotube bundles; and processing a plurality of signals associated with the set of characteristic parameters.

14. The method of claim 13, wherein the set of characteristic parameters of the set of carbon nanotube bundles is selected from the group consisting of: (i) electrical capacitance of the set of carbon nanotube bundles; (ii) electrical resistance of the set of carbon nanotube bundles; (iii) stiffness of the set of carbon nanotube bundles; (iv) electrical inductance of the set of carbon nanotube bundles; and (v) tensile strength of the set of carbon nanotube bundles.

15. The method of claim 13, wherein the variations on the set of characteristic parameters are caused by a set of characteristics of the spoken sound.

16. The method of claim 15, wherein the set of characteristics of the spoken sound is selected from the group consisting of: (i) air molecule number density in the spoken sound; (ii) velocity of air molecules in the spoken sound; (iii) mass of air molecules in the spoken sound; and (iv) randomness in motion direction of air molecules in the spoken sound.

17. The method of claim 13, further comprising:

detecting variations on a set of dynamic characteristics of the spoken sound, wherein the set of dynamic characteristics is selected from the group consisting of: (i) sound loudness; (ii) sound pitch; and (iii) sound quality including timbre and richness.

18. The method of claim 17, further comprising:

passing a signal of the variations on the set of dynamic characteristics to an apparatus for processing the spoken sound.

* * * * *